US006727861B2

(12) United States Patent
Antoine

(10) Patent No.: US 6,727,861 B2
(45) Date of Patent: Apr. 27, 2004

(54) SATELLITE ANTENNA MOUNTING APPARATUS AND METHOD

(75) Inventor: Mark J. Antoine, Lafayette, LA (US)

(73) Assignee: Satellite Accessories, LLC, Lafayette, LA (US)

( * ) Notice: Subject to any disclaimer, the term of this patent is extended or adjusted under 35 U.S.C. 154(b) by 0 days.

(21) Appl. No.: 10/038,755

(22) Filed: Dec. 31, 2001

(65) Prior Publication Data

US 2003/0122728 A1 Jul. 3, 2003

(51) Int. Cl.[7] ..... H01Q 1/12

(52) U.S. Cl. ..... 343/878; 343/883; 343/892; 248/237

(58) Field of Search ..... 343/765, 766, 343/878, 880, 881, 882, 883, 890, 892, 901, DIG. 2; 248/201, 237

(56) References Cited

U.S. PATENT DOCUMENTS 4,510,502 A 4/1985 Hovland et al.
5,082,037 A * 1/1992 Hammons et al. ..... 144/286.5
5,334,990 A 8/1994 Robinson
5,617,680 A 4/1997 Beatty
5,647,567 A 7/1997 Pugh, Jr. et al.
5,829,724 A 11/1998 Duncan
5,961,092 A * 10/1999 Coffield ..... 248/539
6,037,913 A * 3/2000 Johnson ..... 343/882
6,195,066 B1 2/2001 Pegues, Jr. et al.

* cited by examiner

*Primary Examiner*—Tho Phan
(74) *Attorney, Agent, or Firm*—Allen, Dyer, Doppelt, Milbrath & Gilchrist, P.A.

(57) ABSTRACT

A mounting bracket includes a single mount for attaching to the soffit of a building for adjustably carrying a satellite dish antenna. The mount includes a base having holes for receiving screws to secure the mount to structural members such as studs or trusses to which the soffit is attached. A body portion of the mount includes a bore for receiving an arm of the mounting bracket. One end of the arm includes a plate adapted for attaching the arm to a satellite antenna dish assembly. Once the arm is positioned within the mount, setscrews lock the arm in its desired place within the bore, thus securing the satellite antenna to a desired location on the soffit.

21 Claims, 14 Drawing Sheets

20
12
52
16
28
46
18
60
25
14
11
62

SATELLITE ANTENNA MOUNTING APPARATUS AND METHOD

FIELD OF THE INVENTION

This application is generally related to antenna mounting brackets and more particularly to a telescoping bracket for mounting and aligning a satellite antenna disk.

BACKGROUND OF THE INVENTION

While the physical size required of satellite dish antennas for receiving clear audio and video signals has decreased as a result of increased satellite receiver sensitivity, the reduced size has made it desirable to mount satellite antennas on a building such as a residence. Typically, an unobstructed view of an appropriate satellite operable with the antenna is achieved by mounting the antenna on the roof or sidewall of the building. Mounting on what is typically a pitched roof often results in diminishing the integrity of the roof causing leaks as a result of drilling through the roofing material into rafters for obtaining structural integrity for the mounting. Mounting to sidewalls typically requires penetrating concrete block and the need for special tools and concrete anchors as suggested in U.S. Pat. No. 6,195,066 to Peques, Jr. et al. describing a satellite dish mounting arm for mounting to a vertical sidewall of a building. As identified in the '066 patent, the cantilever support avoids problems associated with mounting the dish to the eaves of the building, which eaves are known to have an inherent structurally weakness, especially for houses. So it would seem to those in the art of mounting such satellite disk antennas.

U.S. Pat. No. 5,647,567 to Pugh, Jr. et al. for an antenna mounting bracket further emphasizes that manufacturers typically advise users to avoid mounting the antenna on the eave of a house because of the eave's lack of rigidity, stating that if the deficient rigidity could be overcome, an eave would be an ideal location for mounting the antenna. By way of example, the eave location allows an installer to avoid having to mount the antenna to a chimney, directly to the roof, or on a typically obstructed southern sidewall of the building. The eave can provide almost any side of the building for satisfying the need for unobstructed signal reception while better blending the antenna within the profile of the building. To account fro the eave structural deficiency, the '567 patent teaches use of a reinforcing antenna mount including an arm having a back plate to be secur4ed to a sidewall of the building plus a brace to secure a telescoping arm to the eave, while an end of the telescoping arm is secured to the antenna.

With the devices and methods known in the art, such as the roof mounting structure of U.S. Pat. No. 5,617,680 to Beatty and the multi-bracketed wall mounting structures of U.S. Pat. No. 5,829,724 to Duncan and U.S. Pat. No. 4,510,502 to Hovland et al., by way of example, there remains a need to provide a satellite antenna mounting method and apparatus that has minimal elements for ease on installation and still provides a wide variety of locations about the building for obtaining an unobstructed signal from the satellite communication with the antenna.

SUMMARY OF THE INVENTION

In view of the foregoing background, it is therefore an object of the present invention to provide a mounting apparatus and method for easily and inexpensively securing a satellite antenna to a building. It is further an object of the invention to provide an apparatus and method for mounting the antenna to an eave of a building while maintaining sufficient structural integrity when supporting the antenna under its planned use.

These and other objects, features and advantages according to the present invention are provided by an apparatus for mounting a satellite antenna dish assembly to a soffit of a building, the apparatus comprising a mount including a base portion having a body portion attached thereto. The base portion includes a plurality of holes for securing the mount to a soffit by screwing the base into a stud or truss member to which the soffit is attached. The body portion includes a bore for receiving an elongate arm slidable within the bore. One end of the arm includes a plate adapted for attaching the arm to a satellite antenna dish assembly. A lock secures the elongate arm to the body portion. In one preferred embodiment, the arm is locked in place within the bore using a rib longitudinally extending along a peripheral portion of the body portion, the rib having a plurality of threaded holes extending therethrough and into the bore for receiving setscrews to bias against elongate arm and thus secure the arm to the mount. In a preferred embodiment of the present invention, the elongate arm has a circular cross-section for allowing the arm to be received within the bore, also having a circular cross-section. For the embodiment of a single mount herein described, the body portion of the mount is integrally formed with the base portion, and a riser portion separating the base from the body portion.

In a method aspect of the present invention, mounting a satellite antenna to an eave of a building comprises providing a mount including a base portion having a body portion including a plurality of holes for securing the mount to a soffit. The mount is positioned onto a soffit such that the holes are aligned with a supporting member, such as a truss or stud, to which the soffit is attached, the soffit being positioned between the base portion and the supporting member. The mount is then secured to the soffit by having screws extend through the holes, through the soffit, and into the structural member. An elongate arm having a free end and an opposing end for attached a satellite dish assembly is slidably extended into the bore with the elongate arm positioned within the bore for permitting the opposing end to place the satellite antenna beyond the eave of the building. Once held in a desired position, the elongate arm is secured to the mount using setscrews threaded into the arm through the body portion, thus securing the satellite antenna to the eave of the building.

BRIEF DESCRIPTION OF THE DRAWINGS

A preferred embodiment of the present invention as well as others that will become more apparent by referring to the following detailed description and drawings incorporated herein and forming a part of the specification to illustrate examples of embodiments of the invention, in which.

DETAILED DESCRIPTION OF PREFERRED EMBODIMENTS

The present invention will now be described more fully with reference to the accompanying drawings in which preferred embodiments of the invention are shown and described. It is to be understood that the invention may be embodied in many different forms and should not be construed as limited to the illustrated embodiments set forth herein. Rather, the applicant provides these embodiments so that this disclosure will be thorough and complete, and will convey the scope of the invention to those skilled in the art. Like numbers refer to like elements there through.

Figure 1:
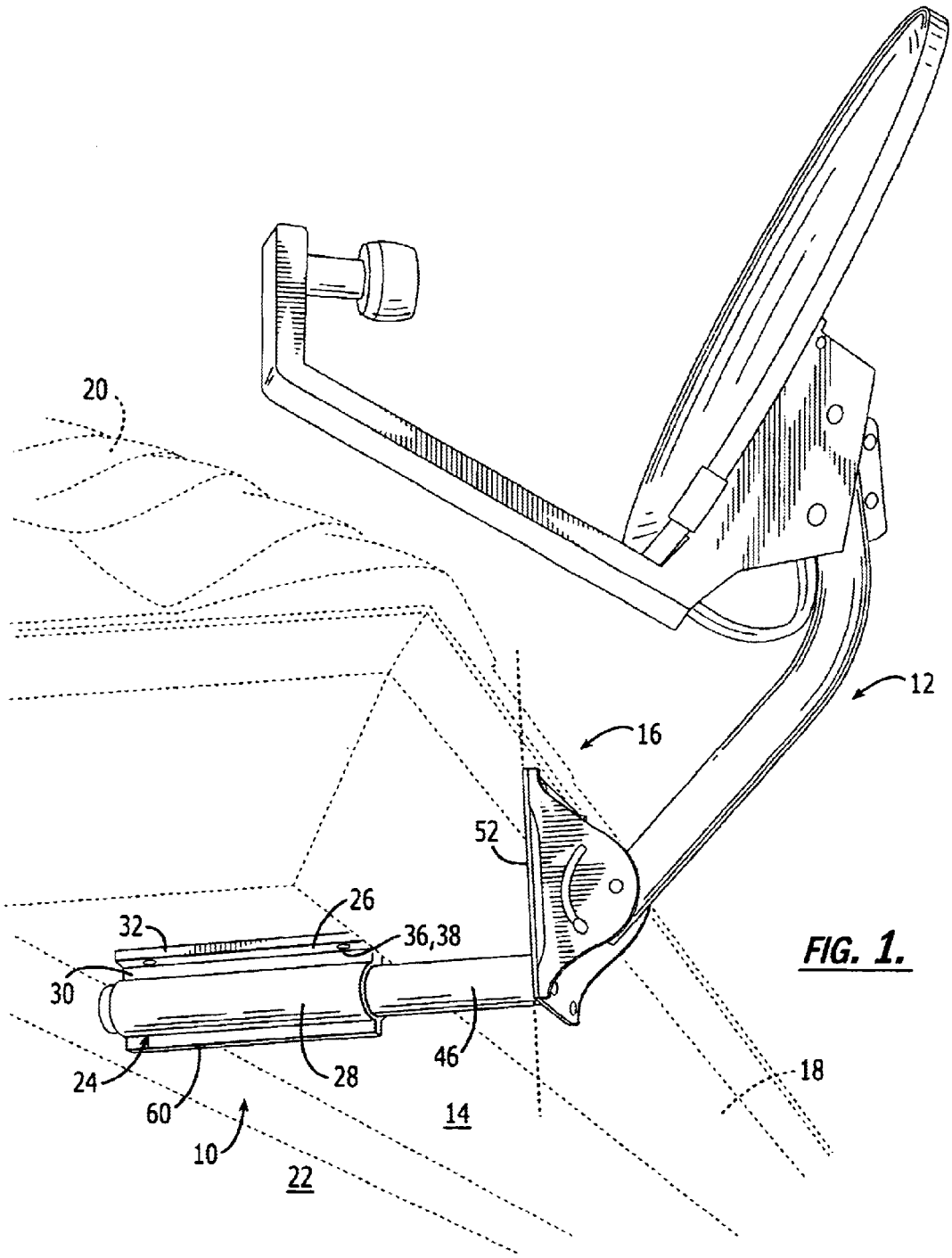
FIG. 1 is a left front perspective view of one embodiment of the present invention illustrating a satellite dish antenna mounted to an eave of a building.
Figure 2:
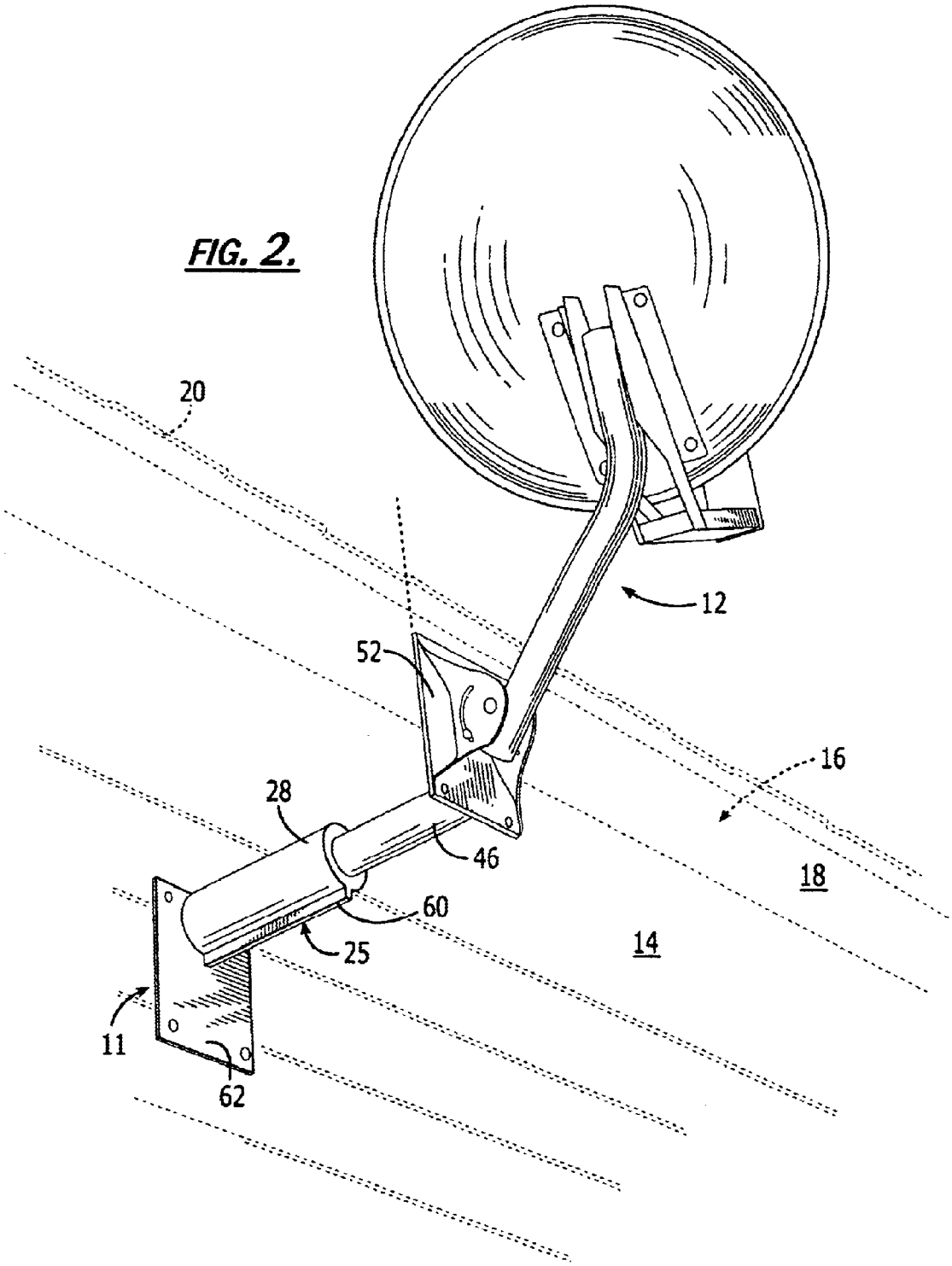
FIG. 2 is a left front perspective view of an alternate embodiment of the present invention illustrating a satellite dish antenna mounted to a sidewall of a building under an eave thereof.

As illustrated initially with reference to FIG. 1, one embodiment of the present invention includes a mounting bracket 10, an apparatus for mounting a satellite antenna dish assembly 12 to a soffit 14 of a building 16 for supporting the assembly 12 from the soffit and extending it beyond the fascia 18 and edge of the roof 20. An alternate embodiment of the present invention includes a bracket 11 mounted to a sidewall 22 of the building 16 as illustrated with reference to FIG. 2. Both functional features of each apparatus 10, 11, as well as preferred ornamental designs will be herein described.

Figure 3:
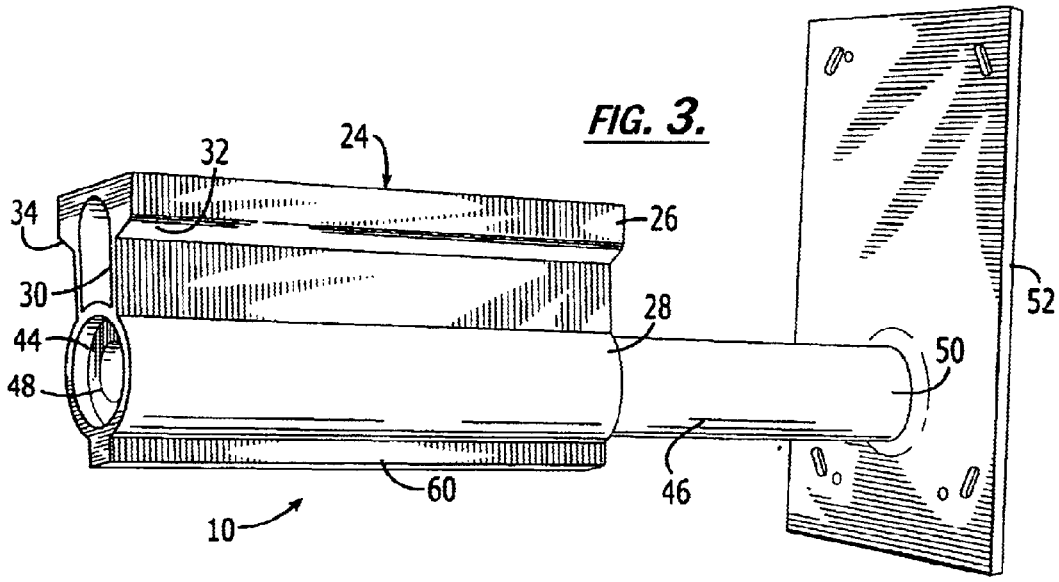
FIG. 3 is a right side perspective view of the present invention as illustrated in one use in FIG. 1.
Figure 4:
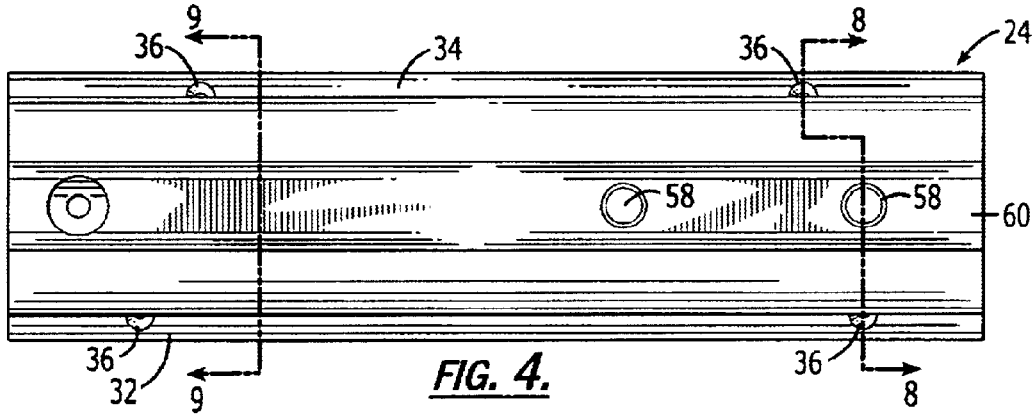
FIG. 4 is a top plan view of a single mount of FIG. 3.
Figure 5:
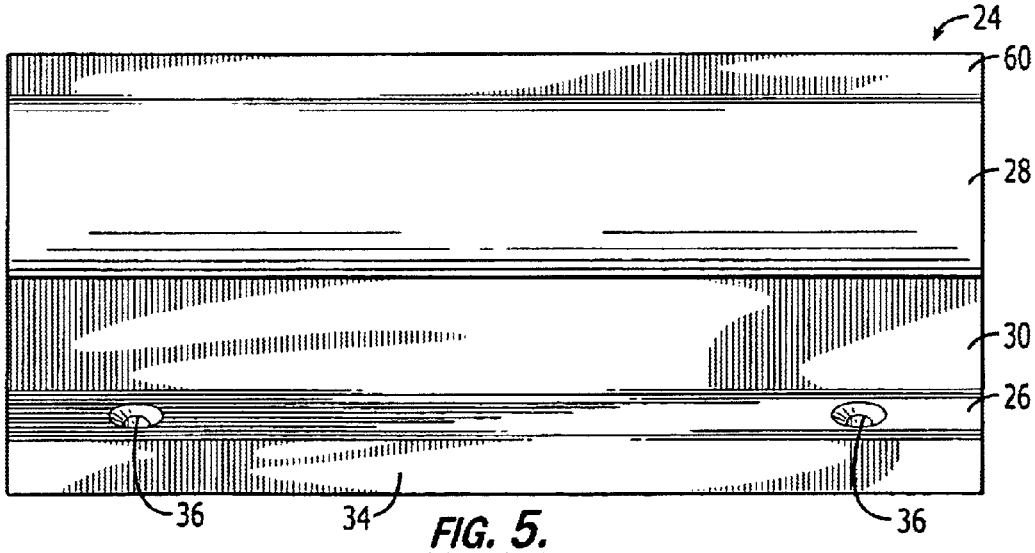
FIGS. 5 and 6 are left and right side views of the single mount of FIG. 4.
Figure 6:
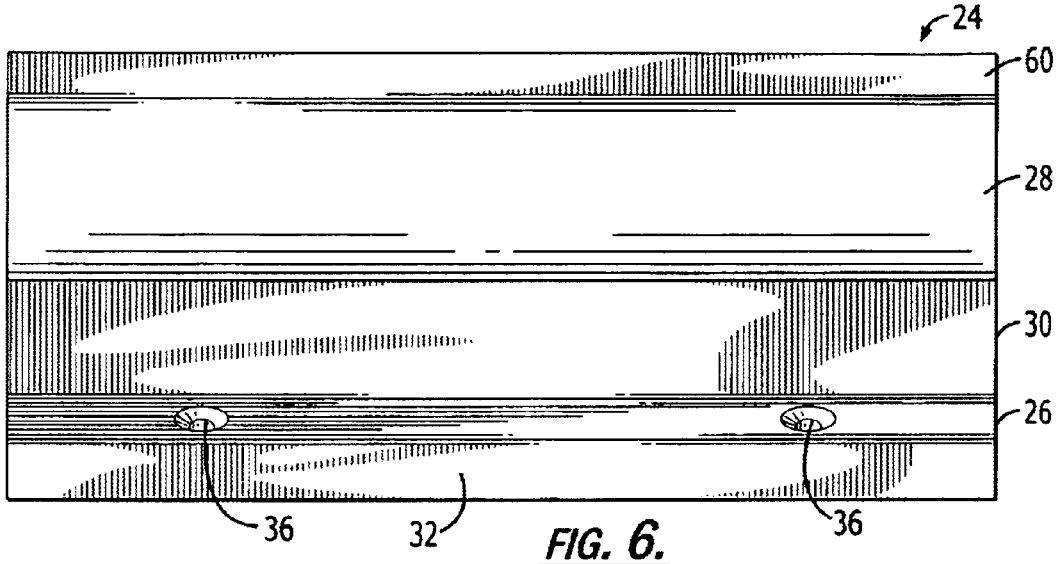

With reference now to FIG. 3, one preferred embodiment of the mounting bracket 10 comprises a single mount 24 including a base portion 26 and a body portion 28 attached to the base portion through a riser 30, all of which are integrally formed. The use of a single mount 24 as herein described permits easy installation of the satellite dish assembly 12 and avoids the need for excess supporting elements typically thought to be needed. It is anticipated that the mount 24 will be formed from an extruding process, casting process, or by mechanical attaching of each portion, as desired and without departing form the teachings of the present invention. The riser 30 is positioned so as to form opposing flanges 32, 34 on the base potion 26, as further illustrated with reference to FIGS. 4–6. The flanges 32, 34 as herein described for one preferred embodiment are elongate and extend longitudinally alone the body portion 28. Alternatively, a plurality of flange portions may be employed now having the teachings of the present invention. The elongate flanges as herein described provide an esthetically pleasing appearance and enhance the thought of simplicity for the mount. Alternatively, there may be no rib.

Figure 7:
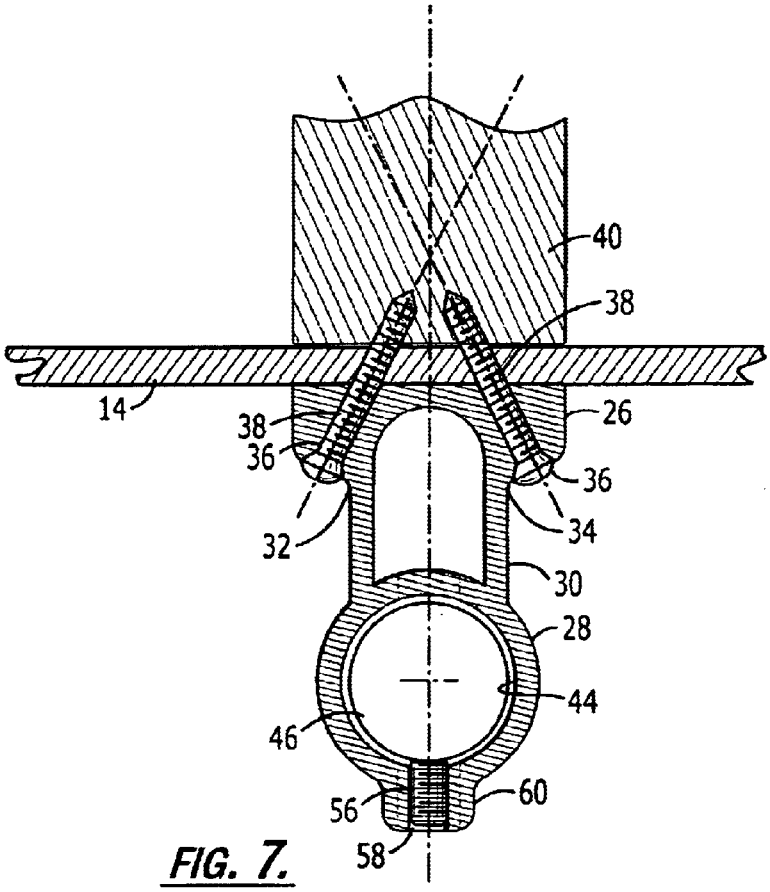
FIG. 7 is a partial cross-section view illustrating an attachment of the embodiment of FIGS. 4–6 to a soffit and truss assembly.
Figure 8:
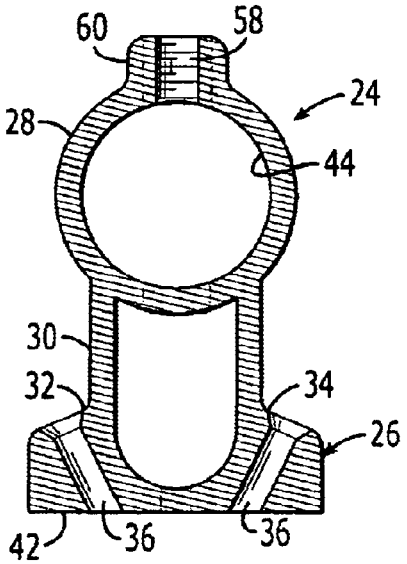
FIG. 8 is a partial cross-section view taken through lines 8—8 of FIG. 4.
Figure 9:
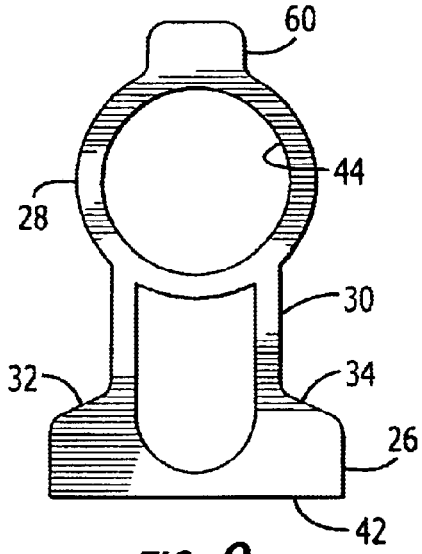
FIG. 9 is a partial cross-section view taken through lines 9—9 of FIG. 4.
Figure 10:
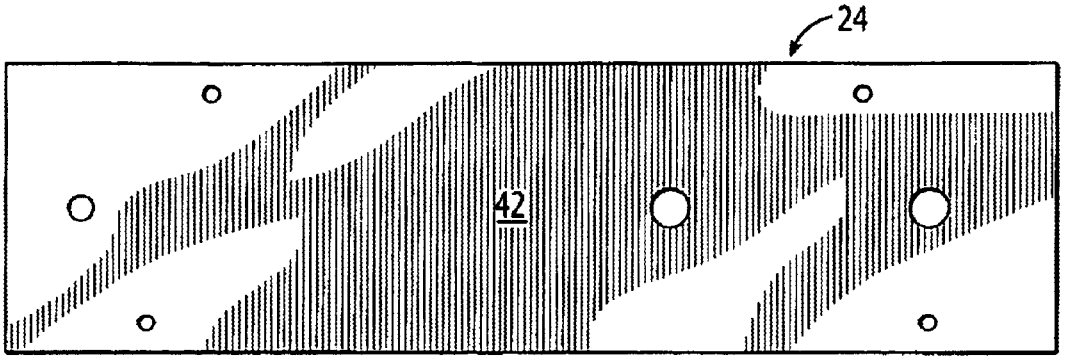
FIG. 10 is a bottom plan view of the single mount of FIG. 3.

A plurality of holes 36 within the flanges 32, 34 permit the attaching of the single mount 24 to the soffit 14 preferably using screws 38 screwed through the soffit and into a soffit supporting structure 40 such as a metal or wood, stud or truss, as illustrated with reference to FIGS. 7–9. As herein illustrated, the holes 36 are inwardly angled to permit ease in anchoring to the structure 40. Typically, a bottom wall 42 of the mount 24 will be flat, as illustrated with reference to FIG. 10 to accommodate the generally flat surface of the soffit 14. However, it is expected that alternate surface shapes may be desired depending on the structures to which the mount 24 is attached.

With reference again to FIGS. 3 and 7, by way of example, the body portion 28 is elongate in one preferred embodiment and generally cylindrical in shape, and includes a bore 44 having a circular cross-section for slidably and rotatably receiving an elongate arm 46 having a complementing circular cross-section. The elongate arm 46 includes one end 48 slidable within the bore and an opposing second end 50 adapted for attaching to the satellite antenna dish assembly 12 earlier described with reference to FIGS. 1 and 2. In one preferred embodiment, a plate 52 is attached to the second end 50 for securing the arm 46 to the assembly 12. The plate 52 may have a rectangular shape as illustrated with reference to FIG. 3, or alternate shapes to suit the needs of a particular antenna being mounted. In the mount 24 herein described by way of example, the bore passes entirely through the body portion 28 for permitting the elongate arm 46 to be longitudinally displaced beyond that of a bore that only passes partially into the body portion, an acceptable alternative to the design while keeping within the teachings of the present invention. Further, the riser 30 may have various height dimensions depending on the separation desired between the soffit 14 and the body portion 28, and thus the arm 46. There may be no riser as an alternative.

With reference again to FIGS. 3, 7 and 8, by way of example, a lock 54 for detachably securing the elongate arm 46 to the body portion 28 includes a plurality of setscrews 56 operable within threaded holes 58 in the body portion for securing the arm within the bore 44. In one preferred embodiment of the present invention, and as herein described by way of example, the body portion 28 is formed as an elongate tube with a rib 60 longitudinally extending along a peripheral portion of the body portion. The rib 60 provides additional tube wall strengthening and is a preferred location for the threaded holes 58 for receiving the setscrews 56 used to removably secure the arm 46 to the mount 24. The rib 60 may alternatively be formed as a plurality of rib portions, a thicker wall portion, or other form as may be desired. The use of a rib permits use of a small walled tube for the body portion. The elongate rib as herein described provides an esthetically pleasing appearance and enhances the thought of simplicity for the mount. Alternatively, there may be no rib.

A method for mounting a satellite antenna, the satellite dish assembly 12 as herein described by way of example, and using the mounting bracket 10, may comprise positioning the bottom wall 42 of the mount 24 onto the soffit 14 such that the holes 36 are aligned to permit screws 38 to be secured into the supporting structure 40 as illustrated with reference again to FIG. 7, the soffit being positioned between the base portion 26 and the supporting structure 40. The mount is secured to the soffit by the screws, but alternatively may be secured by other attaching means such as gluing and nailing. Screws are herein described by way of example, and are preferred to allow ease in removal of the mount for relocation.

The arm 46 is positioned into the bore 44 and secured therein using the setscrews 56. In one preferred method, the satellite dish assembly 12 is attached to the plate 52 at the end of the arm 46. The assembly 12 and arm 46 combination is then slidably and rotatably connected to the mount 24. The assembly 12 is aligned as desired. The setscrews 56 are then tightened to secure the arm 46 and thus the assembly 12 in place.

Figure 11:
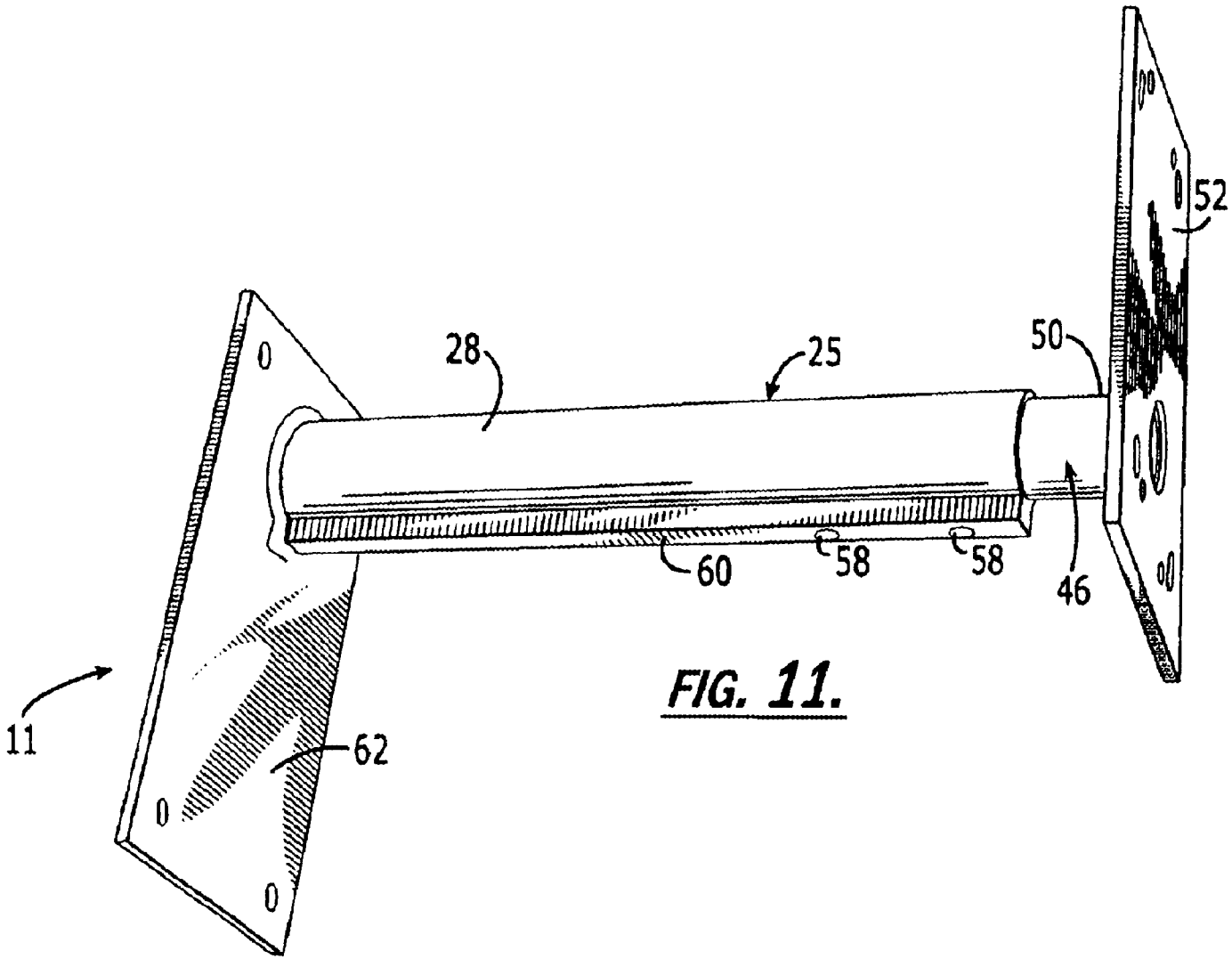
FIG. 11 is a left side perspective view of the alternate embodiment of the present invention as illustrated in one use in FIG. 2.
Figure 12:
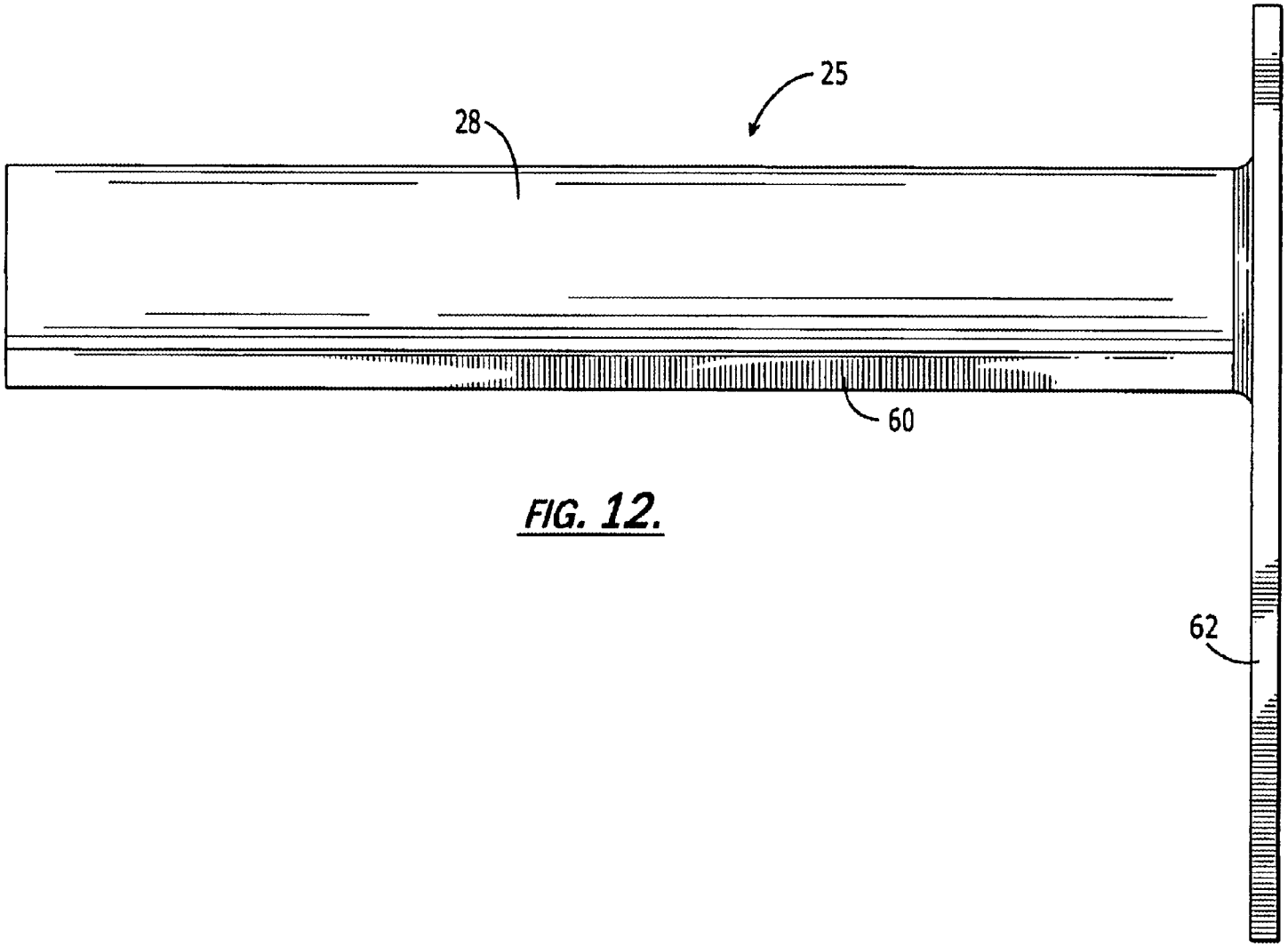
FIG. 12 is a side view of the mount embodiment of FIG. 11, the opposing side view being a mirror image thereof.
Figure 13:
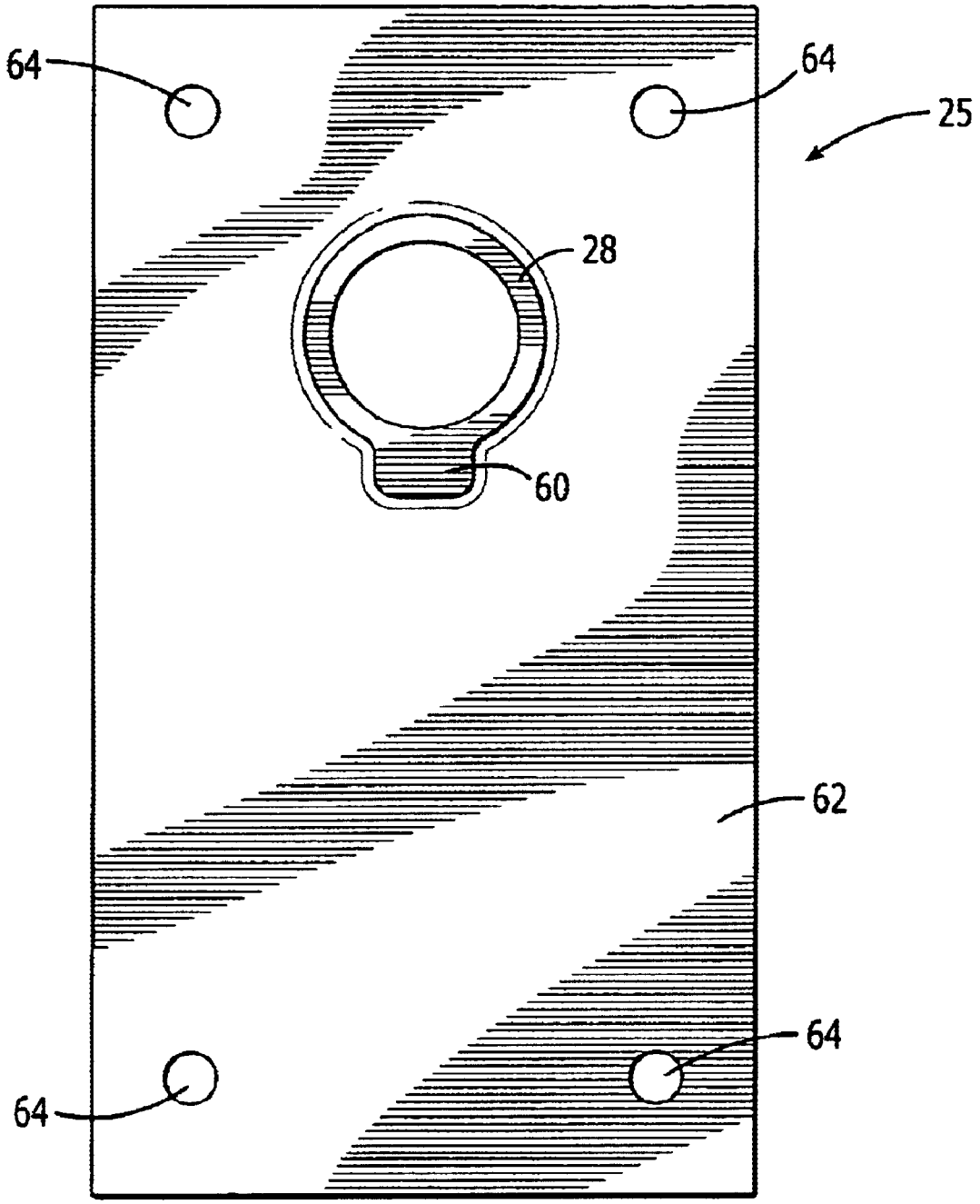
FIG. 13 is a front view of the embodiment of FIG. 12.
Figure 14:
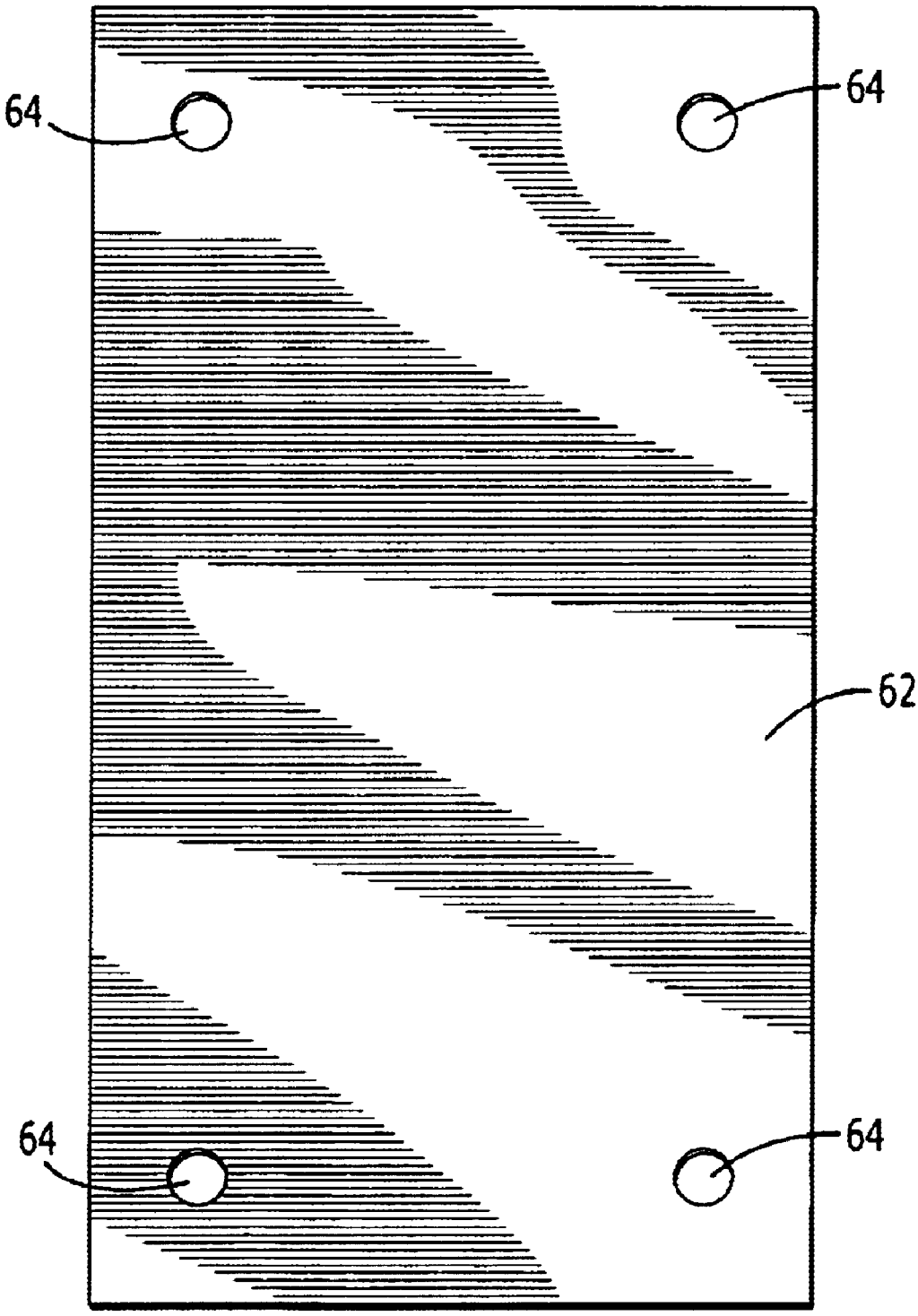
FIG. 14 is a rear view of the embodiment of FIG. 12.
Figure 15:
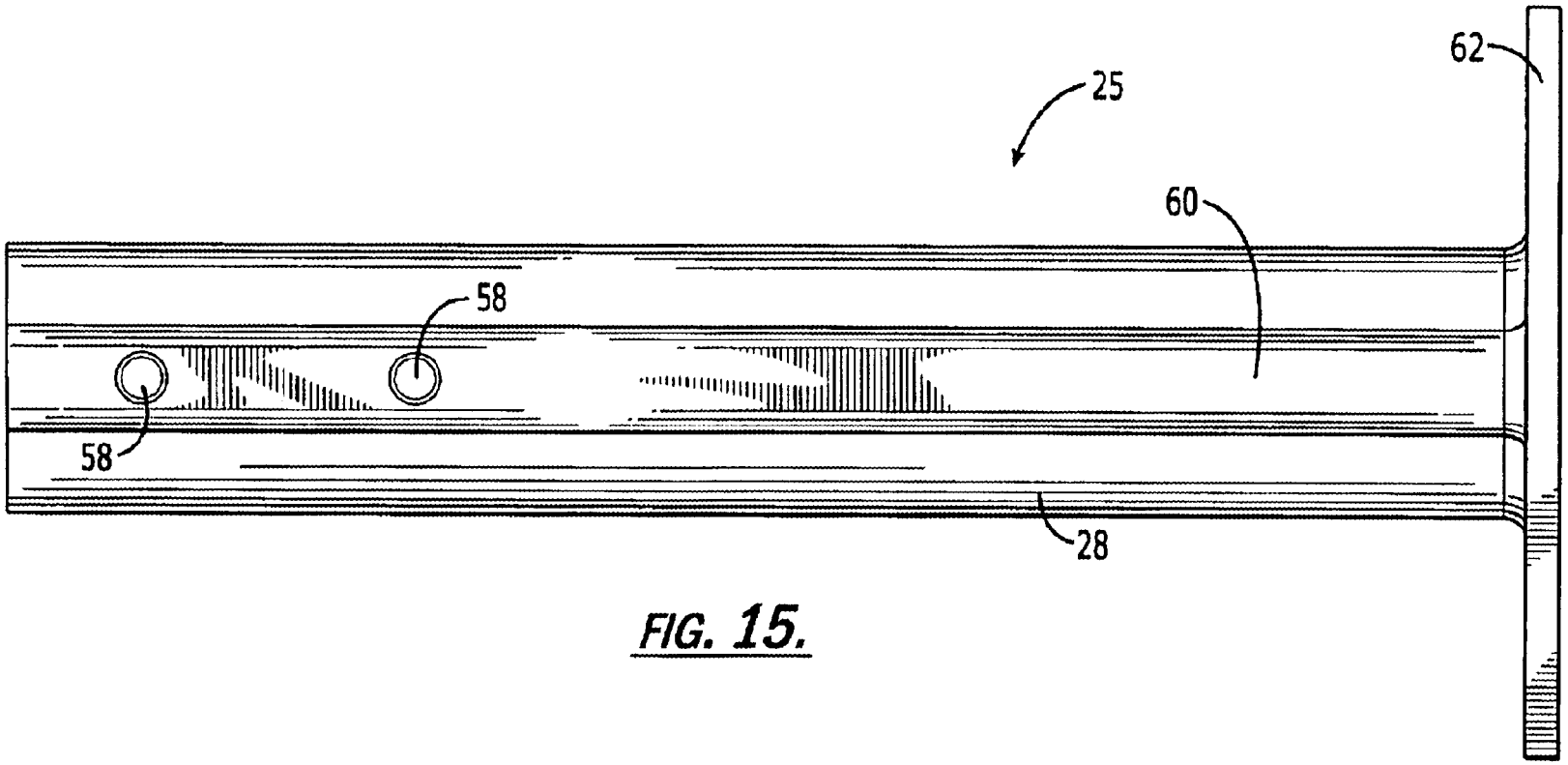
FIG. 15 is a bottom view of the embodiment of FIG. 12.
Figure 16:
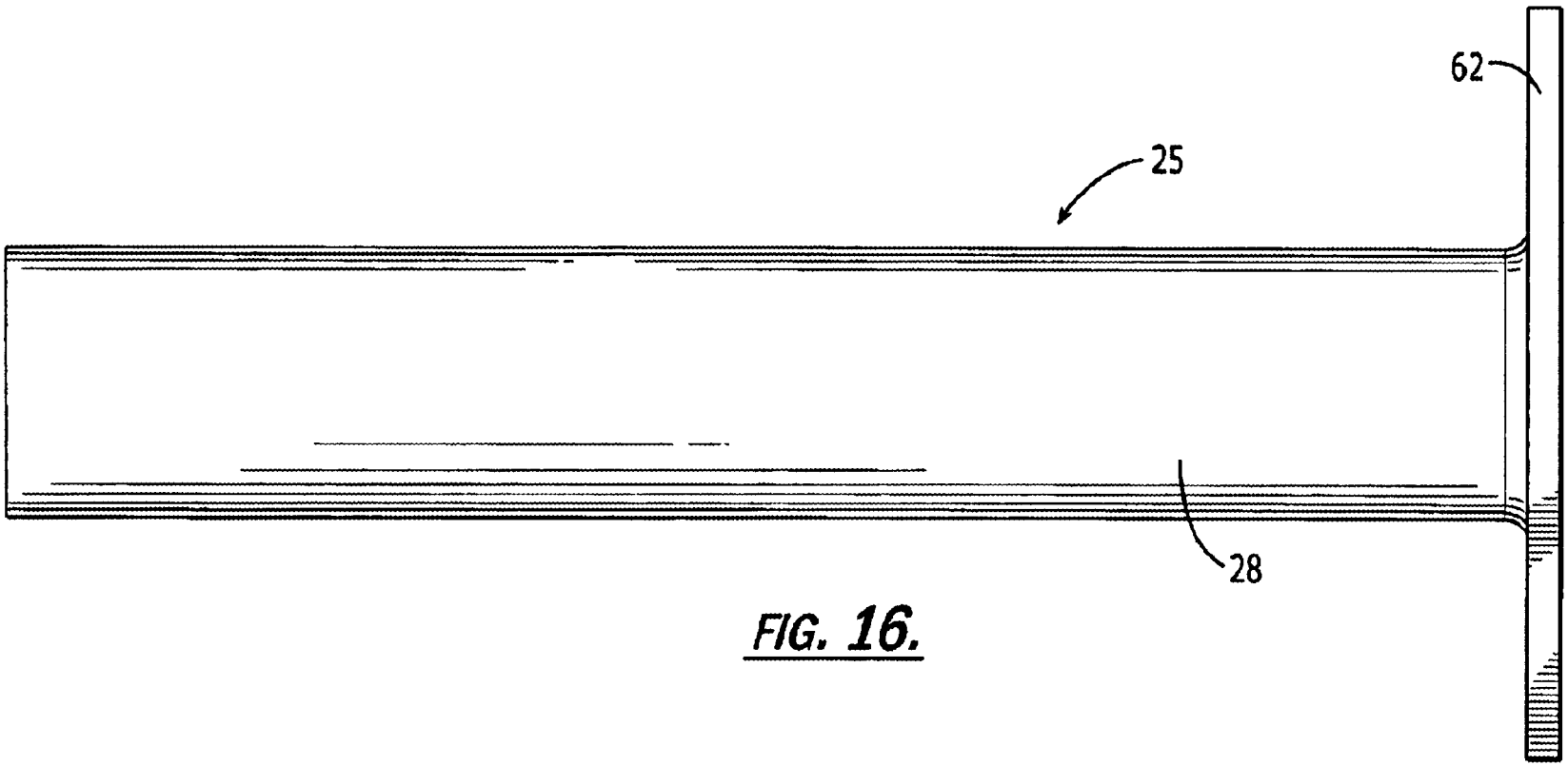
FIG. 16 is a top view of the embodiment of FIG. 12.

In the mounting bracket 11 described earlier with reference to FIG. 2, the body portion 28 and rib 60, as well as the elongate arm 46 and plate 52 described with reference to the soffit mounting bracket 10 are effective when used in the wall mounting bracket 11 illustrated with reference to FIG. 11. Further, the arm 46 and plate 52 combination above described may be a common element for both mounting brackets 10, 11.

With reference to FIGS. 12–16, the wall mounting bracket 11 comprises a mount having the body portion 28 having the elongate rib 60 together attached to a wall mount flange 62 having a plurality of holes 64 for mounting the flange 62 to the sidewall 22, as illustrated with reference again to FIG. 2. The rib 60 includes the threaded holes 58, as earlier described for securing the arm 46 into the bore 44. In a method of installation, the flange 62 is attached to the sidewall 22. The satellite dish assembly is attached to the plate 52 of the arm 46, and the assembly 12 and arm 46 combination is rotatably and slidably connected to the body portion 28, and aligned as desired. The setscrews 56 are then secured against the arm 46 for locking the arm and thus the assembly in place.

Figure 17:
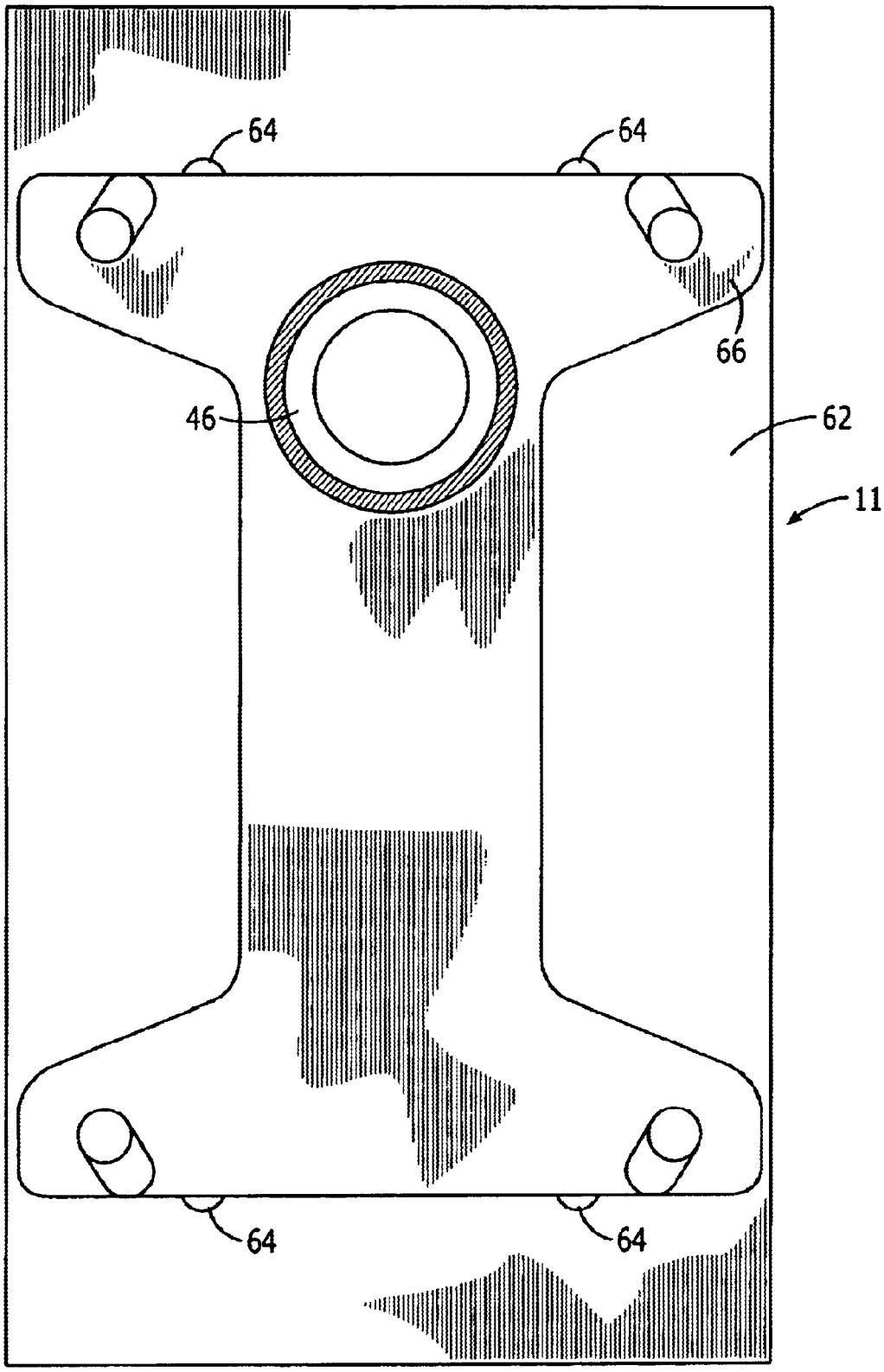
FIG. 17 is an end view of an alternate embodiment of the bracket of FIG. 2.

By way of further example, and with reference to FIG. 17, the plate 52 may have alternate shapes such as the hourglass or I-beam shape herein described without departing from the teachings of the present invention. As above described, the arm 46 and plate 52, 66 may be used in either bracket 10, 11.

Figure 18:
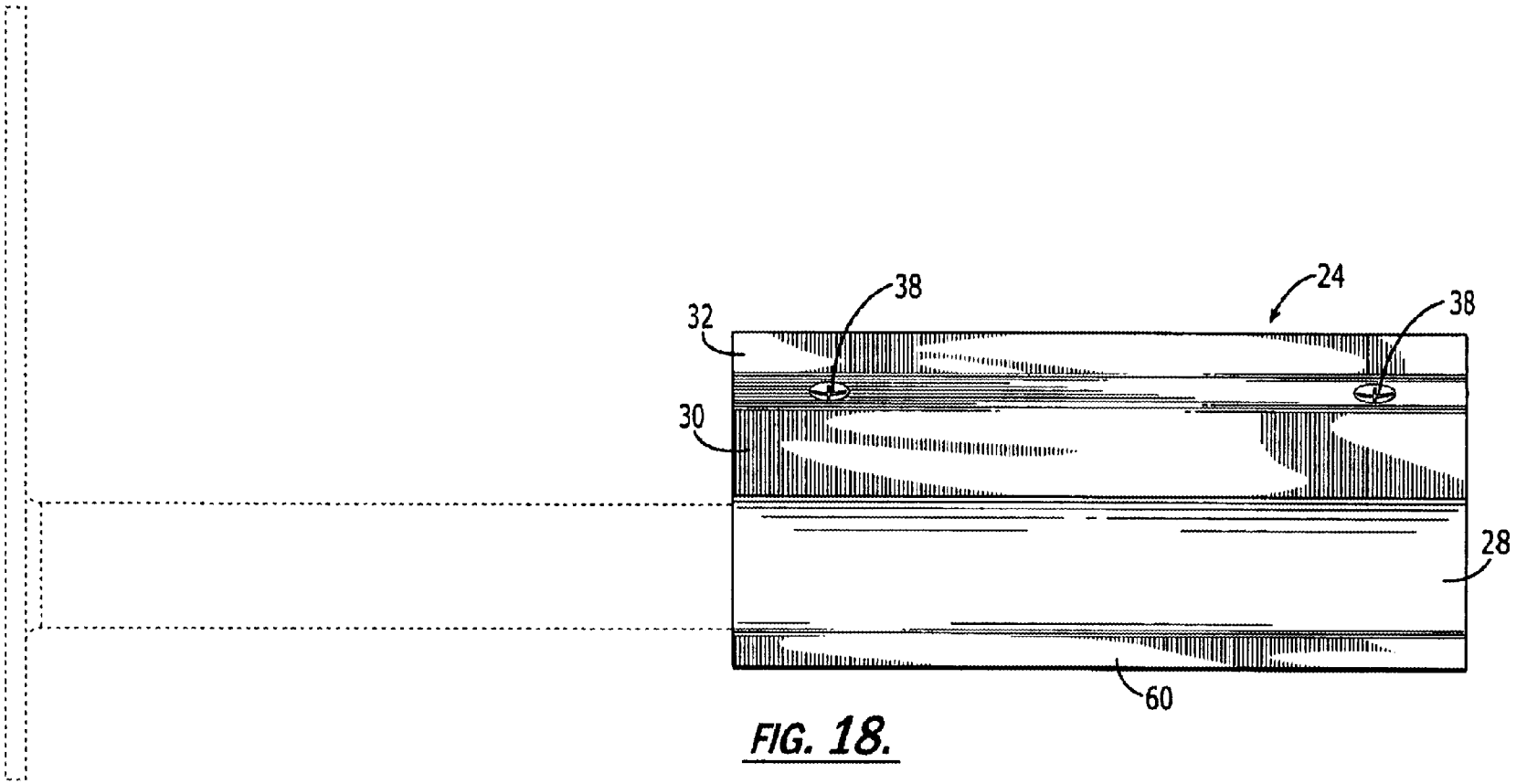
FIGS. 18 and 19 are side views illustrating the alternate mount embodiments of FIGS. 1 and 2 respectively, while including arm members in phantom view.
Figure 19:
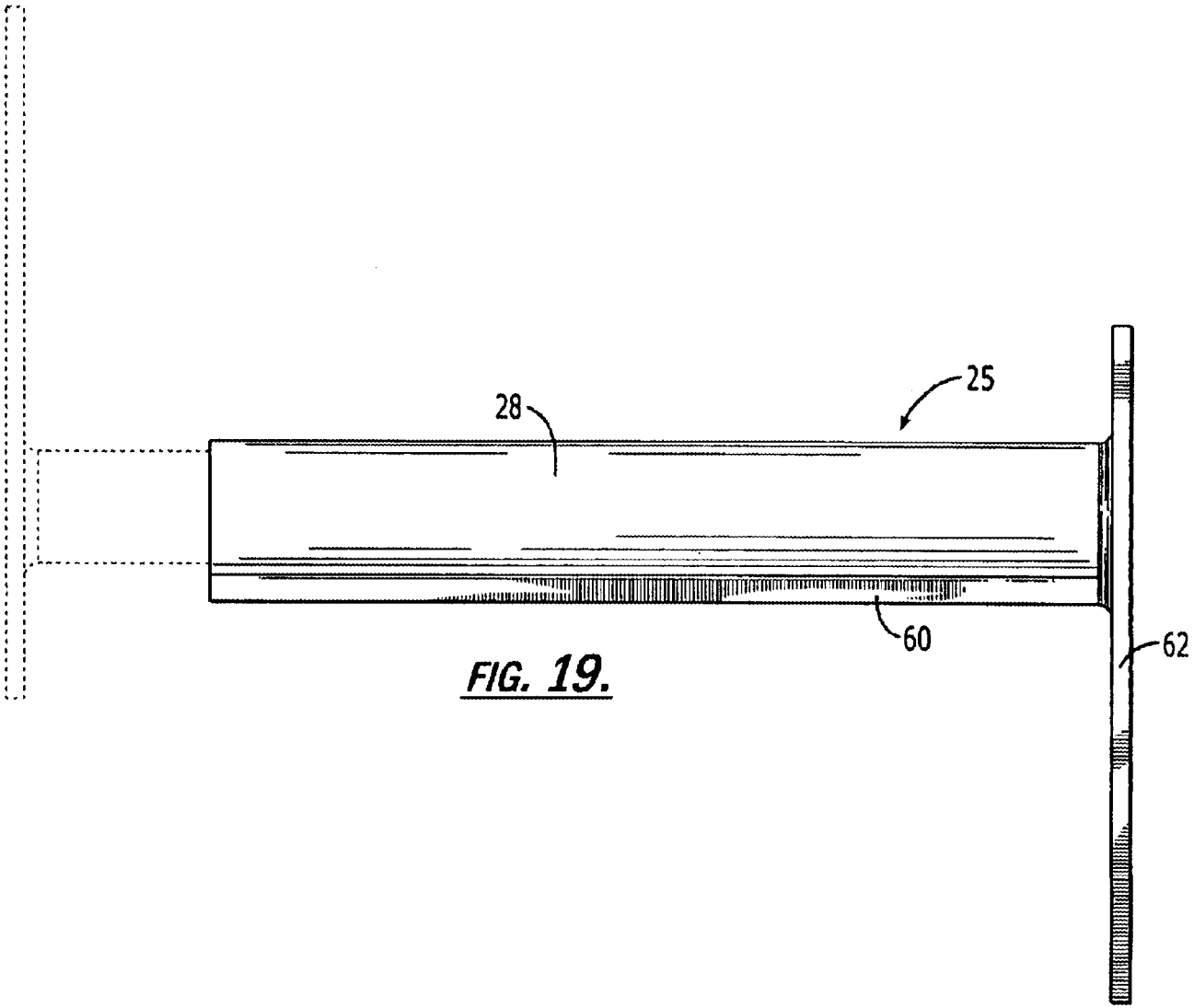

Yet further, while function and structure of alternate embodiments of the present invention as herein described in detail, it is to be understood that appearance of each embodiment promotes their acceptance and use. By way of example, a homeowner ready to attaché a mounting bracket to his home in order to receive a satellite signal would prefer the "cleanest" looking and simplest looking design such a those described earlier and illustrated by way of further example with reference to FIGS. 18 and 19 for the mounts 24, 25.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

That which is claimed is:

1. An apparatus for mounting a satellite antenna dish assembly to a soffit of a building, the apparatus comprising:

a mount including a base portion having a body portion attached thereto, the base portion including opposing flange portions having a plurality of holes therethrough for use in securing the mount to the soffit, the body portion having a bore for receiving an elongate arm therein;

an elongate arm slidable within the bore, wherein one end thereof is adapted for attaching to the satellite antenna dish assembly; and a lock for detachably securing the elongate arm to the body portion.

2. An apparatus according to claim 1, wherein the lock comprises a plurality of setscrews operable within the body portion for securing the elongate arm within the bore.

3. An apparatus according to claim 1, wherein the body portion comprises an elongate tubular member and wherein the lock comprises a rib longitudinally extending along a peripheral portion of the body portion, the rib and body portion having a plurality of threaded holes therethrough cooperating for receiving setscrews therein for securing the elongate arm to the mount.

4. An apparatus according to claim 1, wherein the opposing flange portions extend longitudinally along the base and body portions.

5. An apparatus according to claim 1, wherein the bore extends through the body portion for permitting the elongate arm to pass therethrough.

6. An apparatus according to claim 1, further comprising a riser separating the body portion from the base portion.

7. An apparatus according to claim 1, wherein the elongate arm includes a circular cross-section dimensioned for being closely received within the bore having a circular cross-section.

8. An apparatus according to claim 1, wherein the body portion is integrally formed with the base portion.

9. An apparatus for mounting a satelite antenna dish assembly to a soffit of a building, the apparatus comprising:

a single mount including a base portion having an elongate tubular body portion attached thereto, the base portion having a plurality of holes therethrough for securing the mount to the soffit, the body portion having a bore therein; and a lock carried by the body portion for securing the elongate arm to the body portion, wherein the lock comprises a rib longitudinally extending along a peripheral portion of the elongate tubular body portion, the rib and elongate tubular body portion having a plurality of threaded holes therethrough cooperating for receiving setscrews therein for securing the elongate arm to the single mount.

10. An apparatus according to claim 9, wherein the lock comprises a plurality of setscrews operable within the body portion for securing the enlongatearm within the bore.

11. An apparatus according to claim 9, further comprising a riser separating the body portion from the base portion, wherein the riser is attached to the base portion for providing opposing flange portions.

12. An apparatus according to claim 9, further comprising an elongate arm having a circular cross-section to be closely received within the bore, wherein the bore includes having a circular cross-section.

13. An apparatus comprising:

a single mount including a base portion having a body portion attached thereto, the base portion having a plurality of holes therethrough, wherein the body includes a bore having a circular cross-section, the body portion further including a rib extending along a peripheral portion of the body portion, the rib having a plurality of holes extending into the bore for receiving locks; and a plurality of locks carried within the plurality of holes for securing the elongate arm to the singie mount.

14. An apparatus according to claim 13, wherein the plurality of locks comprises a plurality of setscrews operable for securing the elongate arm within the bore.

15. An apparatus according to claim 13, further comprising a riser connecting the body portion to the base portion.

16. An apparatus according to claim 13, further comprising an elongate arm having a cylindrical shape, wherein the elongate arm is received within the bore.

17. A method for mounting a satellite antenna to an eave of a building, the method comprising:

providing a mount including a base portion having an elongate tubular body portion attached thereto, the base portion having a plurality of holes therethrough for securing the mount to a soffit, the elongate tubular body portion having a bore for receiving an elongate arm therein, the mount further having a rib longitudinally extending along a peripheral portion of the elongate body portion, wherein the rib and the elongate tubuiar body portion having a plurality of threaded holes therethrough cooperating for receiving setscrews therein for securing the elongate arm to the mount, and wherein the elongate arm includes a free end and an opposing end;

positioning the mount onto the soffit such that the plurality of holes are aligned with a supporting member to which the soffit is attached, the soffit being positioned between the base portion and supporting member;

securing the mount to the soffit by passing a plurality of screws through the plurality of holes into the supporting member;

slidably extending the free end of the elongate arm within the bore;

positioning the elongate arm within the bore for permitting the opposing end to position the satellite antenna beyond the eave of the building; and securing the elongate arm to the mount for thus securing the satellite antenna to the eave of the building, wherein securing the elongate arm includes tightening a plurality of setscrews operable within the threaded holes.

18. A method according to claim 17, further comprising attaching the satellite antenna to the opposing end of the elongate arm prior to the arm positioning within the bore.

19. A method according to claim 17, wherein securing the elongate arm includes tightening a plurality of setscrews operable within the body portion for securing the elongate arm within the bore.

20. A method according to claim 17, wherein the elongate arm includes a circular cross-section dimensioned for being closely received within the bore having a circular cross-section, and wherein the positioning of the elongate arm further includes rotating the elongate arm about a longitudinal axis for permitting the opposing end to position the satellite antenna at a desired orientation to the eave of the building.

21. An apparatus for mounting a satellite antenna dish assembly to a soffit of a building, the apparatus comprising:

a mount including a base portion having an elongate tubular body portion attached thereto, the base portion having a plurality of holes therethrough for use in securing the mount to the soffit;

an elongate arm slidable within the bore, wherein one end thereof is adapted for attaching to a satellite antenna dish assembly thereto; and a lock for detachably securing the elongate arm to the body portion, wherein the lock comprises a rib longitudinally extending along a peripheral portion of the elongate tubular body portion, the rib and elongate tubular body portion having a plurality of threaded holes therethrough cooperating for receiving setscrews therein for securing the elongate arm to the mount.

* * * * *